US006189415B1

(12) United States Patent
McQuillin

(10) Patent No.: US 6,189,415 B1
(45) Date of Patent: Feb. 20, 2001

(54) DEVICE FOR PROVIDING PROPER CLEARANCE WHEN DRIVING A NAIL

(76) Inventor: Thomas McQuillin, 183 Plain Rd., Westmoreland, NH (US) 03467

( * ) Notice: Under 35 U.S.C. 154(b), the term of this patent shall be extended for 0 days.

(21) Appl. No.: 09/498,968

(22) Filed: Feb. 7, 2000

(51) Int. Cl.[7] ..... B25C 3/00
(52) U.S. Cl. ..... 81/44; 81/177.8
(58) Field of Search ..... 81/44, 487, 177.8

(56) References Cited

U.S. PATENT DOCUMENTS

| | | | | |
|---|---|---|---|---|
| 1,417,338 | * | 5/1922 | Lenahan | 81/177.8 |
| 2,349,339 | * | 5/1944 | Cloer | 81/44 |
| 2,783,799 | * | 3/1957 | Hart | 81/44 |
| 4,079,764 | * | 3/1978 | Hayes | 81/44 |
| 5,321,996 | * | 6/1994 | Wei | 81/44 |

FOREIGN PATENT DOCUMENTS

| | | | | |
|---|---|---|---|---|
| 566451 | * | 4/1958 | (BE) | 81/44 |
| 195077 | * | 2/1908 | (DE) | 81/44 |

* cited by examiner

*Primary Examiner*—David A. Scherbel
*Assistant Examiner*—Joni B. Danganan
(74) *Attorney, Agent, or Firm*—Richard L. Miller

(57) ABSTRACT

A device for providing proper clearance when driving a nail having a head into a surface. The device includes a handle, a blade, an anvil, and apparatus that rotatably attaches the blade to the handle. The handle is held in a hand of a user. The blade extends rotatably from, and is replaceably attached to, the handle and captures the nail between the head of the nail and the surface when the nail is being driven into the surface. When the nail is driven into the surface, the blade provides the proper clearance. The anvil is disposed on the handle, opposes the blade, and is hit sideways to free the blade from between the head of the nail and the surface after the nail has been driven into the surface.

16 Claims, 1 Drawing Sheet

DEVICE FOR PROVIDING PROPER CLEARANCE WHEN DRIVING A NAIL

BACKGROUND OF THE INVENTION

1. Field of the Invention

The present invention relates to a device for providing proper clearance. More particularly, the present invention relates to a device for providing proper clearance when driving a nail.

2. Description of the Prior Art

Numerous innovations for nail sets have been provided in the prior art. Even though these innovations may be suitable for the specific individual purposes to which they address, however, they differ from the present invention. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a device for providing proper clearance when driving a nail that avoids the disadvantages of the prior art.

Another object of the present invention is to provide a device for providing proper clearance when driving a nail that is simple and inexpensive to manufacture.

Still another object of the present invention is to provide a device for providing proper clearance when driving a nail that is simple to use.

Briefly stated, yet another object of the present invention is to provide a device for providing proper clearance when driving a nail having a head into a surface. The device includes a handle, a blade, an anvil, and apparatus that rotatably attaches the blade to the handle. The handle is held in a hand of a user. The blade extends rotatably from, and is replaceably attached to, the handle and captures the nail between the head of the nail and the surface when the nail is being driven into the surface. When the nail is driven into the surface, the blade provides the proper clearance. The anvil is disposed on the handle, opposes the blade, and is hit sideways to free the blade from between the head of the nail and the surface after the nail has been driven into the surface.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

Figure 1:
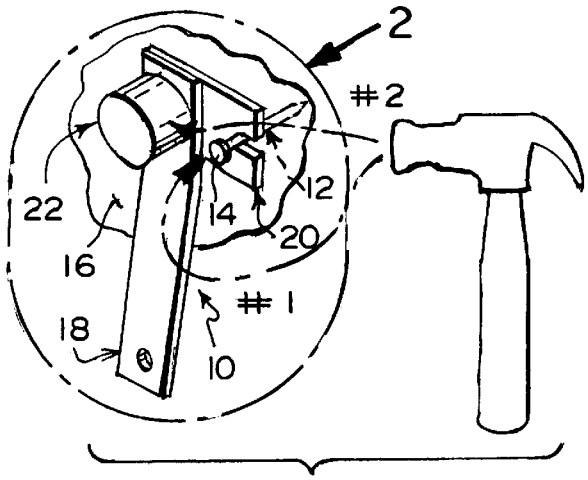
FIG. 1 is an exploded diagrammatic perspective view of the present invention in use.
Figure 5:
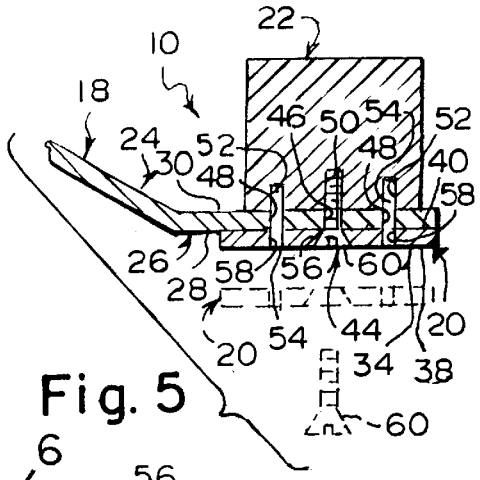
FIG. 5 is an exploded diagrammatic cross sectional view taken on line 5—5 in FIG. 2.
Figure 6:
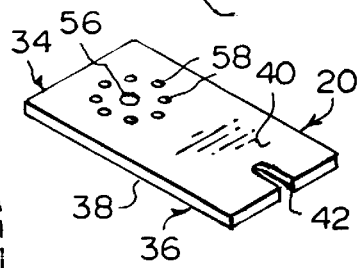
FIG. 6 is a reduced diagrammatic perspective view of the area generally enclosed by the dotted curve identified by arrow 6 in FIG. 2 of the blade plate of the present invention.
Figure 2:
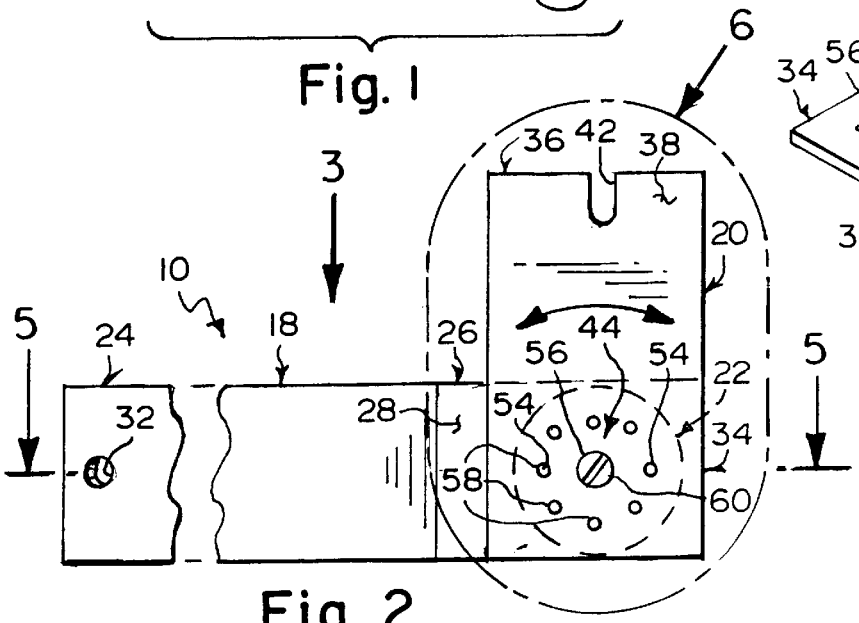
FIG. 2 is an enlarged diagrammatic bottom plan view of the area generally enclosed by the dotted curve identified by arrow 2 in FIG. 1 of the present invention.
Figure 3:
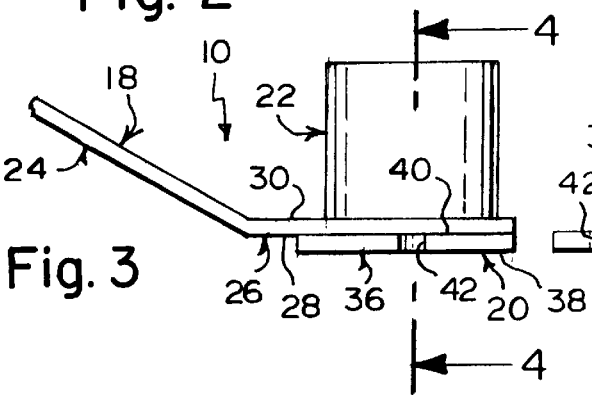
FIG. 3 is a reduced diagrammatic side elevational view taken generally in the direction of arrow 3 in FIG. 2.
Figure 4:
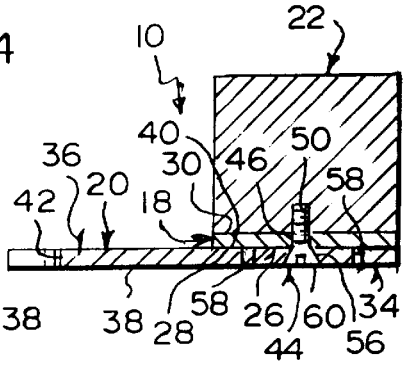
FIG. 4 is a diagrammatic cross sectional view taken on line 4—4 in FIG. 3.

| LIST OF REFERENCE NUMERALS UTILIZED IN THE DRAWING | |
|---|---|
| 10 | device of the present invention for providing proper clearance when driving nail 12 having head 14 into surface 16 |
| 12 | nail |
| 14 | head of nail |
| 16 | surface |
| 18 | handle for holding in hand of user |
| 20 | blade for capturing nail 12 between head 14 of nail 12 and surface 16 when nail 14 is being driven into surface 16 |
| 22 | anvil for being hit sideways to free blade 20 from between head 14 of nail 12 and surface 16 after nail 12 has been driven into surface 16 |
| 24 | proximal end of handle 18 for holding in hand of user |
| 26 | distal end of handle 18 |
| 28 | surface-facing surface of distal end 26 of handle 18 |
| 30 | non-surface-facing surface of distal end 26 of handle 18 |
| 32 | throughbore in proximal end 24 of handle 18 for hanging up device 10 when not in use |
| 34 | proximal end of blade 20 |
| 36 | distal end of blade 20 |
| 38 | surface-facing surface of blade 20 |
| 40 | non-surface-facing surface of blade 20 |
| 42 | free throughslot in distal end 36 of blade 30 for sliding onto and capturing nail 12 |
| 44 | apparatus for rotatably attaching proximal end 34 of blade 20 to surface-facing surface 28 of distal end 26 of handle 18 for facilitating positioning of device 10 during use |
| 46 | pivot throughbore in distal end 26 of handle 18 |
| 48 | pair of pin throughbores in distal end 26 of handle 18 |
| 50 | pivot blindbore in anvil 22 |
| 52 | pair of pin blindbores in anvil 22 |
| 54 | pair of pins of anvil 22 |
| 56 | pivot throughbore in proximal end 34 of blade 20 |
| 58 | plurality of pin throughbores in proximal end 34 of blade 20 |
| 60 | pivot screw of apparatus 44 |

DETAILED DESCRIPTION OF THE PREFERRED EMBODIMENT

Referring now to the figures, in which like numerals indicate like parts, and particularly to FIG. 1, the device of the present invention is shown generally at 10 for providing proper clearance when driving a nail 12 having a head 14 into a surface 16.

The overall configuration of the device 10 can best be seen in FIGS. 2–6, and as such, will be discussed with reference thereto.

The device 10 comprises a handle 18 for holding in a hand of a user.

The device 10 further comprises a blade 20 that extends rotatably from, and is replaceably attached to, the handle 18 for capturing the nail 12 between the head 14 of the nail 12 and the surface 16 when the nail 14 is being driven into the surface 16.

When the nail 12 is driven into the surface 16, the blade 20 provides the proper clearance.

The device 10 further comprises an anvil 22 that is disposed on the handle 18, opposes the blade 20, and for being hit sideways to free the blade 20 from between the head 14 of the nail 12 and the surface 16 after the nail 12 has been driven into the surface 16.

The handle 18 is slender, elongated, and has a proximal end 24 that is flat for holding in the hand of the user and a distal end 26 that is flat and bent upwardly from the proximal end 24 of the handle 18, towards the anvil 22.

The distal end 26 of the handle 18 has a surface-facing surface 28 and a non-surface-facing surface 30.

The proximal end 24 of the handle 18 has a throughbore 32 for hanging up the device 10 when not in use.

The blade 20 is a planar plate, and has a proximal end 34, a distal end 36, a surface-facing surface 38, and a non-surface-facing surface 40.

The proximal end 34 of the blade 20 is rotatably and replaceably attached to the distal end 26 of the handle 18, with the non-surface-facing surface 40 of the blade 20 abutting the surface-facing surface 28 of the distal end 26 of the handle 18.

The distal end 36 of the blade 10 has a free throughslot 42 for sliding onto and capturing the nail 12.

The anvil 22 is disposed on the non-surface-facing surface 30 of the distal end 26 of the handle 18.

The device 10 further comprises apparatus 44 for rotatably attaching the proximal end 34 of the blade 20 to the surface-facing surface 28 of the distal end 36 of the handle 18 for facilitating positioning of the device 10 during use.

The apparatus 44 includes the distal end 26 of the handle 18 having a pivot throughbore 46 that extends centrally therethrough.

The apparatus 44 further includes the distal end 26 of the handle 18 further having a pair of pin throughbores 48 that extend therethrough, longitudinally therealong, and straddle the pivot throughbore 46 therein.

The apparatus 44 further includes the anvil 22 having a pivot blindbore 50 that is threaded, extends centrally therein, and is in alignment with the pivot throughbore 46 in the distal end 26 of the handle 18.

The apparatus 44 further includes the anvil 22 further having a pair of pin blindbores 52 that extend therein, longitudinally therealong, straddle the pivot throughbore 50 therein, and are in alignment with the pair of pivot throughbores 48 in the distal end 26 of the handle 18.

The apparatus 44 further includes the anvil 22 further having a pair of pins 54 that are disposed in, and depend from, the pair of pin blindbores 52 in the anvil 22, and extend snugly through the pair of pin throughbores 48 in the distal end 26 of the handle 18.

The apparatus 44 further includes the proximal end 34 of the blade 20 having a pivot throughbore 56 that extends centrally therethrough and is in alignment with the pivot throughbore 46 in the distal end 26 of the handle 18.

The apparatus 44 further includes the proximal end 34 of the blade 20 further having a plurality of pin throughbores 58 that extend therethrough, concentrically outboard of, and around, the pivot throughbore 56 therein, and with a diametrical pair thereof, alienable with, and snugly receiving, the pair of pins 54, once the blade 20 has been removed, properly oriented, and replaced.

The apparatus 44 further includes a pivot screw 60 that extends through the pivot throughbore 56 in the proximal end 34 of the blade 20, through the pivot throughbore 46 in the distal end 26 of the handle 18, and threadably into the pivot blindbore 50 in the anvil 22.

When the pivot screw 60 of the apparatus 44 is tightened, the pair of pins 54 are maintained in a respective pair of pin throughbores 58 in the proximal end 34 of the blade 20 and thereby eliminate unwanted rotation of the blade 20 relative to the handle 18, once a desired position therefor has been established.

It will be understood that each of the elements described above, or two or more together, may also find a useful application in other types of constructions differing from the types described above.

While the invention has been illustrated and described as embodied in a device for providing proper clearance when driving a nail, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for providing proper clearance when driving a nail having a head into a surface, comprising:

a) a handle for holding in a hand of a user;

b) a blade extending rotatably from, and being replaceably attached to, said handle for capturing the nail between the head of the nail and the surface when the nail is being driven into the surface, and when the nail is driven into the surface, said blade providing the proper clearance; and c) an anvil disposed on said handle, opposing said blade, for being hit sideways to free said blade from between the head of the nail and the surface after the nail has been driven into the surface, wherein said handle is slender, elongated, and has:

A) a proximal end that is flat for holding in the hand of the user; and

B) a distal end that is flat and bent upwardly from said proximal end of said handle, towards said anvil, and has:

i) a surface-facing surface; and ii) a non-surface-facing surface, wherein said blade is a planar plate, and has:

I) a proximal end;

II) a distal end;

III) a surface-facing surface; and

IV) a non-surface-facing surface, wherein said proximal end of said blade is rotatably and replaceable attached to said distal end of said handle, with said non-surface-facing surface of said blade abutting said surface-facing surface of said distal end of said handle.

2. The device as defined 1, wherein said proximal end of said handle has a throughbore for hanging up said device when not in use.

3. The device as defined in claim 1, wherein said distal end of said blade has a free throughslot for sliding onto and capturing the nail.

4. The device as defined in claim 1, wherein said anvil is disposed on said non-surface-facing surface of said distal end of said handle.

5. A device for providing proper clearance when driving a nail having a head into a surface, comprising:

a) a handle for holding in a hand of a user;

b) a blade extending rotatably from, and being replaceably attached to, said handle for capturing the nail between the head of the nail and the surface when the nail is being driven into the surface, and when the nail is driven into the surface, said blade providing the proper clearance; and c) an anvil disposed on said handle, opposing said blade, for being hit sideways to free said blade from between the head of the nail and the surface after the nail has been driven into the surface, wherein said handle is slender, elongated, and has:

A) a proximal end that is flat for holding in the hand of the user; and

B) a distal end that is flat and bent upwardly from said proximal end of said handle, towards said anvil, and has:

i) a surface-facing surface; and ii) a non-surface-facing surface, wherein said blade is a planar plate, and has:

I) a proximal end;

II) a distal end;

III) a surface-facing surface; and

IV) a non-surface-facing surface; further comprising means for rotatably attaching said proximal end of said blade to said surface-facing surface of said distal end of said handle for facilitating positioning of said device during use.

6. The device as defined in claim 5, wherein said means includes said distal end of said handle having a pivot throughbore that extends centrally therethrough.

7. The device as defined in claim 6, wherein said means further includes said distal end of said handle further having a pair of pin throughbores that extend therethrough, longitudinally therealong, and straddle said pivot throughbore therein.

8. The device as defined in claim 7, wherein said means further includes said anvil having Divot blindbore that is threaded, extends centrally therein, and is in alignment with said pivot throughbore in said distal end of said handle.

9. The device as defined in claim 8, wherein said means further includes said anvil further having a pair of pin blindbores that extend therein, longitudinally therealong, straddle said pivot throughbore therein, and are in alignment with said pair of pivot throughbores in said distal end of said handle.

10. The device as defined in claim 9, wherein said means further includes said anvil further having a pair of pins that are disposed in, and depend from, said pair of pin blindbores in said anvil, and extend snugly through said pair of pin throughbores in said distal end of said handle.

11. The device as defined in claim 10, wherein said means further includes said proximal end of said blade having a pivot throughbore that extends centrally therethrough and is in alignment with said pivot throughbore in said distal end of said handle.

12. The device as defined in claim 11, wherein said means further includes said blade further having a plurality of pin throughbores that extend therethrough, concentrically outboard of, and around, said pivot throughbore therein, and with a diametrical pair thereof alignable with, and snugly receiving, said pair of pins of said means, once said blade has been removed, properly oriented, and replaced.

13. The device as defined in claim 12, wherein said means further includes a pivot screw that extends through said pivot throughbore in said proximal end of said blade, through said pivot throughbore in said distal end of said handle, and threadably into said pivot blindbore in said anvil, and when said pivot screw is tightened, said pair of pins are maintained in a respective pair of pin throughbores in said proximal end of said blade and thereby eliminate unwanted rotation of said blade relative to said handle, once a desired position therefor has been established.

14. The device as defined in claim 5, wherein said proximal end of said handle has a throughbore for hanging up said device when not in use.

15. The device as defined in claim 5, wherein said distal end of said blade has a free throughslot for sliding onto and capturing the nail.

16. The device as defined in claim 5, wherein said anvil is disposed on said non-surface-facing surface of said distal end of said handle.

* * * * *